US005651830A

United States Patent [19]

Yamaguchi

[11] Patent Number: 5,651,830

[45] Date of Patent: Jul. 29, 1997

[54] METHOD FOR CLEANING SURFACE OF EXTERNAL WALL OF BUILDING

[75] Inventor: Kyouichi Yamaguchi, Tokyo, Japan

[73] Assignee: Total Service Co., Inc., Tokyo, Japan

[21] Appl. No.: 632,916

[22] Filed: Apr. 16, 1996

Related U.S. Application Data

[63] Continuation of Ser. No. 188,021, Jan. 28, 1994, abandoned.

[30] Foreign Application Priority Data

Feb. 1, 1993 [JP] Japan ..... 5-014991

[51] Int. Cl.[6] ..... B08B 3/00; B08B 5/00

[52] U.S. Cl. ..... 134/4; 134/21; 134/26; 134/41; 134/42

[58] Field of Search ..... 134/4, 21, 26, 134/42, 41

[56] References Cited

U.S. PATENT DOCUMENTS

| | | | |
|---|---|---|---|
| 3,583,932 | 6/1971 | Benton et al. | 427/155 |
| 3,915,902 | 10/1975 | Ancel et al. | 252/526 |
| 3,919,729 | 11/1975 | Cannan | 134/21 |
| 4,235,734 | 11/1980 | Scherubel | 252/142 |
| 4,529,449 | 7/1985 | Baustert et al. | 134/4 |
| 4,692,276 | 9/1987 | Schramm | 252/545 |
| 4,849,027 | 7/1989 | Simmons | 134/22.18 |
| 4,974,618 | 12/1990 | Nysted | 134/21 |
| 5,232,632 | 8/1993 | Woo et al. | 252/546 |
| 5,356,479 | 10/1994 | Menke et al. | 134/2 |

*Primary Examiner*—Zeinab El-Arini

*Attorney, Agent, or Firm*—Webb Ziesenheim Bruening Logsdon Orkin & Hanson, P.C.

[57] ABSTRACT

The method for cleaning the surface of an external wall of a building, includes forming and maintaining a layer of foam of a cleaning agent on the surface of an external wall of a building to detach soil deposited on the surface of the external wall by the cleaning action of the cleaning agent, and subsequently removing the cleaning agent foam from the surface of the external wall by, for example, washing with water. In the method, the scattering of the cleaning agent around the building can be prevented by removing the cleaning agent containing soil as it is, in the state of the foam.

12 Claims, 2 Drawing Sheets

(PRIOR ART)

METHOD FOR CLEANING SURFACE OF EXTERNAL WALL OF BUILDING

This is a continuation of application Ser. No. 08/188,021 filed on Jan. 28,1994, now abandoned.

BACKGROUND OF THE INVENTION

The present invention relates to a method for cleaning the surface of an external wall of a building. More particularly, the present invention relates to a method for cleaning the surface of an external wall of a building comprising the steps of applying a cleaning agent to the surface of an external wall of a building and subjecting the external wall surface having the cleaning agent applied thereto to washing with water, etc. to thereby clean the external wall surface, in which the scattering of the cleaning agent containing soil around the building is prevented.

The surface of the external wall of the building is exposed to the air, so that soil is deposited and gradually heaped up on the external wall surface due to the dust contained in the air, exhaust gas, etc. Consequently, periodic cleaning of the external wall surface is desired.

Among various conventional methods for cleaning the surface of such an external wall, the method is generally known in which a worker on a gondola 2 or the like connected to an upper end of a liftable arm wrist 1 as shown in FIG. 2 or suspended from the top of a building applies a liquid cleaning agent to the surface of an external wall 3 of a building to be cleaned through a nozzle 4 or the like, and in which after some time, the surface of the external wall 3 having the cleaning agent applied thereto is washed with water 5 by jetting the same thereonto through the nozzle 4 or the like, as shown in FIG. 3, to thereby remove soil 6 deposited on the surface of the external wall 3 as shown in the figure.

However, in the above conventional method, there has been a drawback in that, in the washing, the cleaning agent 7 containing soil is blown and scattered around the building by the water 5 having been jetted toward and collided against the surface of the external wall 3, so that the foul cleaning agent 7 soils neighboring buildings and trees and flows into sewerage.

Therefore, actually, the area where the cleaning operation can be performed according to the above conventional method, is very limited.

SUMMARY OF THE INVENTION

In view of the above situation, it is an object of the present invention to provide a method for cleaning the surface of an external wall of a building, devised to minimize the scattering of a cleaning agent containing soil around the building at the time of cleaning the external wall surface with a cleaning agent.

In order to attain the above object, the method for cleaning the surface of an external wall of a building according to the present invention comprises a step of forming and maintaining a layer of foam of a cleaning agent on the surface of an external wall of a building and a step of removing the cleaning agent foam from the surface of the external wall of the building.

In this method, any soil deposited on the surface of the external wall of the building is detached by the cleaning action of the cleaning agent foam, and the cleaning agent foam containing the soil can be removed as it is, in the state of the foam, by carrying out, for example, washing with water. This method is advantageous in that the scattering of the cleaning agent containing soil can be prevented.

BRIEF DESCRIPTION OF THE DRAWINGS

FIG. 1(*b*) is a view illustrating the condition of the cleaning agent foam being detached, drawn for the same purpose;

DESCRIPTION OF THE PREFERRED EMBODIMENT

Hereinbelow, the method for cleaning the surface of an external wall of a building according to the present invention will be described in greater detail, referring to FIGS. 1 and 2.

The method for cleaning the surface of an external wall of a building according to the present invention comprises a step (1) of forming and maintaining a layer of foam (or foam in a mousselike form) of a cleaning agent on the surface of an external wall of a building and a step (2) of removing the cleaning agent foam from the surface of the external wall of the building by, for example, washing with water.

Figure 1A:
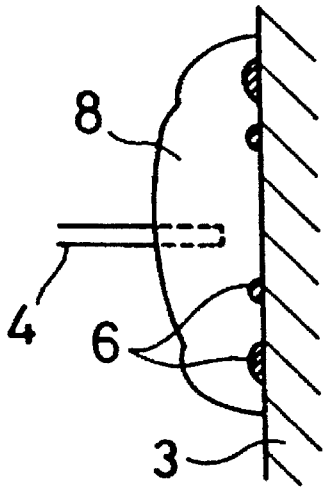
FIG. 1(*a*) is a view illustrating the condition of foam formed of a cleaning agent applied to the surface of an external wall of a building, drawn for explaining the method for cleaning the external wall surface according to the present invention.
Figure 1B:
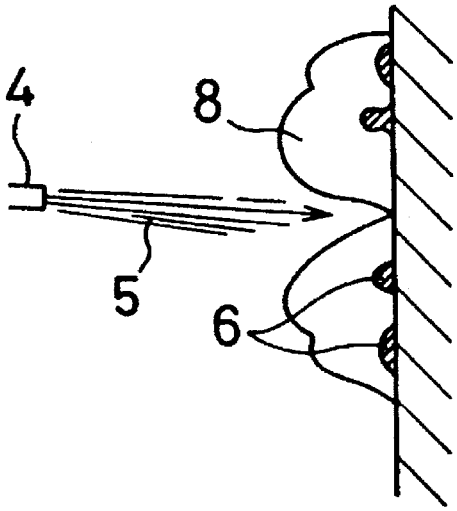
Figure 2:
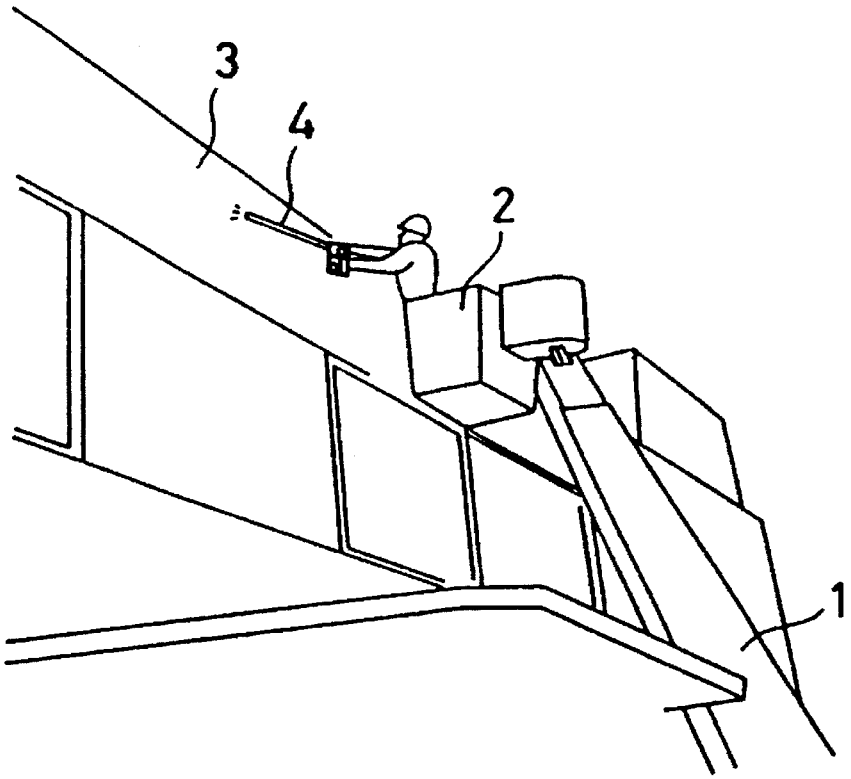
FIG. 2 is a view showing one scene of working for cleaning the surface of an external wall of a building.
Figure 3:
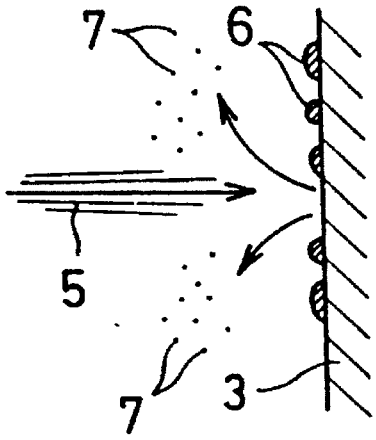
FIG. 3 is a view for explaining the conventional method for cleaning the surface of an external wall of a building.

In the above step (1), the surface of the external wall 3 of the building is covered in the mousselike form by the foam 8 of the cleaning agent jetted through a nozzle 4 or the like, as illustrated in FIG. 1(*a*), and any soil 6 deposited on the surface of the external wall 3 of the building is detached by the cleaning action of the cleaning agent, which is then captured into the foam 8.

In the present invention, in the step (1), the layer of the foam 8 of the cleaning agent formed on the external wall 3 of the building is stably maintained for a prolonged period of time. Hence, it is desired that the cleaning agent be excellent not only in foaming power but also in foam stability, especially in foam stability.

Examples of cleaning agents having excellent foaming power and foam stability include aqueous solutions of anionic, cationic or nonionic surfactants.

Other additives such as acids or alkalis may be incorporated in the cleaning agent, depending on the properties of the material composing the external wall of the building, the type of the soil deposited on the surface of the external wall, etc.

Naturally, the type of the surfactant to be incorporated in the cleaning agent is also appropriately selected, depending on the properties of the material composing the external wall of the building, the type of the soil deposited on the surface of the external wall, etc.

Actually, a large variety of materials, such as stainless steel, aluminum, glass, cement, brick and marble, are employed to compose an external wall of a building. Depending on the properties of each of these materials, a cleaning agent having excellent detergency is selected. Further, in order to prevent the cleaning agent from corroding the external wall material, an appropriate cleaning agent should be selected depending on the properties of the external wall material.

The type of the soil deposited on the external wall of a building varies depending on in what environment the building is erected. For example, on the external wall of a building adjacent to an unpaved road, the main cause of the soil is deposited dust. On the other hand, on the external wall of a building adjacent to a road on which the automobile traffic is heavy, the main cause of the soil is deposits from automobile exhaust gas. An appropriate cleaning agent having excellent detergency is selected depending on the type of the soil as mentioned above.

The foaming power of a surfactant contained in a cleaning agent depends on the pH value, etc. of the cleaning agent. Accordingly, the type of a surfactant to be contained in a cleaning agent is selected depending on what other components than the surfactant, such as acid or alkali components, are contained in the cleaning agent.

When the foam stability of a cleaning agent is poor, a component capable of imparting excellent foam stability, such as saponin or a water-soluble protein, is added to the cleaning agent.

In the present invention, the above cleaning agent having excellent foaming power and foam stability is foamed by the passage therethrough of a gas, such as air, under pressure, and the foam is jetted through, for example, a nozzle head against the surface of an external wall of a building, so that the external wall surface is covered with the cleaning agent in a mousse-like form.

Subsequently, in the cleaning method of the present invention, the step (2) of removing the cleaning agent foam from the surface of the external wall of the building by, for example, washing with water, is carried out.

The cleaning agent foam formed on the surface of the external wall of the building is stably maintained in the mousselike form at the time of the washing with water.

Therefore, in the washing with water of the external wall surface of the building covered with the cleaning agent foam by jetting the water against the external wall surface, referring to FIG. 1(*b*), the water 5 jetted through the nozzle 4 or the like toward the surface of the external wall 3 encounters the resistance by the mousselike layer of the cleaning agent foam 8 prior to colliding against the external wall surface, so that bouncing of the water is substantially inhibited to thereby prevent the scattering of the foul cleaning agent and washing water around the building.

One mode of the cleaning operation conducted in accordance with the method for cleaning the surface of an external wall of a building comprising the above steps (1) and (2) according to the present invention, will now be described with reference to FIG. 2.

First, for example, a gondola 2 connected to an upper end of a liftable arm wrist 1 is arranged so as to be liftable along the surface of an external wall 3 of a building to be cleaned.

This gondola 2 is provided with a cleaning device, a foaming device, a cleaning agent vessel and a water vessel.

Of these, the cleaning device is composed of the above nozzle 4, a jetting unit having an end connected to a rear end of the nozzle 4, which is capable of jetting foam of a cleaning agent or water through the head of the nozzle 4 by pulling a trigger, and a switching unit having an end connected to the other end of the jetting unit, by which switching is performed between jetting of the cleaning agent foam and that of water. In this switching unit, two through holes are provided which are individually connectable, on one end, to the jetting unit upon switching. The other ends of the through holes are respectively connected through flexible hollow tubes to the water vessel and to, via the foaming device, the cleaning agent vessel.

The foaming device is composed of a vertically arranged cylindrical vessel and an air blower connected through a hollow tube to a lower end of the cylindrical vessel.

The above cleaning agent is placed in the cleaning agent vessel. The cleaning agent is transferred from the cleaning agent vessel to the cylindrical vessel of the foaming device, and the air is blown into the cylindrical vessel by means of the air blower so that the cleaning agent of the cylindrical vessel is foamed.

Generally, a worker rides the above gondola 2 provided with the cleaning device, the foaming device, the cleaning agent vessel having the cleaning agent accommodated therein and the water vessel having water accommodated therein, lifts the gondola 2 along the surface of an external wall 3 of a building to be cleaned, and then lowers the gondola 2 from the top of the building while performing the cleaning of the surface of the external wall 3 of the building.

The worker brings the head of the nozzle 4 of the cleaning device close to the surface of the external wall 3 of the building to be cleaned, and the cleaning agent foam is blown onto the external wall surface through the head of the nozzle 4 by operating the cleaning device. Thus, as shown in FIG. 1(*a*), the cleaning agent foam 8 is attached in a mousselike form to the surface of the external wall 3, so that the external wall surface is covered with the cleaning agent foam 8.

Subsequently, the jetting of the cleaning agent foam is switched to that of water by operating the switching unit of the cleaning device. Some time after the covering of the surface of the external wall 3 of the building to be cleaned with the cleaning agent foam 8, water 5 is jetted through the nozzle 4 or the like toward the surface of the external wall 3 covered with the cleaning agent foam 8, as illustrated in FIG. 1(*b*), so that the cleaning agent foam 8 covering the surface of the external wall 3 of the building is removed by the water washing. Thus, cleaning of the surface of the external wall 3 of the building is accomplished.

In the above method for cleaning the surface of an external wall of a building according to the present invention, after forming and maintaining a layer of cleaning agent foam (or foam in a mousselike form) on the external wall surface, the cleaning agent foam is removed from the external wall surface by washing with water. In place of the washing with water, the cleaning agent foam can also be removed from the surface of the external wall of the building by suctioning the foam by the use of a suction device. The suctioning of the cleaning agent foam by the use of the suction device may be followed by washing of the external wall surface with water.

What is claimed is:

1. A method for cleaning soil from a surface of an external wall of a building, comprising the steps of forming and maintaining a layer of a mousselike foam of a cleaning agent on the surface of the external wall of the building; and removing the cleaning agent foam and soil from the surface of the external wall of the building, wherein the cleaning agent is an aqueous solution which includes a surfactant and a compound for imparting foam stability to maintain the layer of foam on the wall surface to prevent scattering of the cleaning agent containing soil during removal.

2. The method for cleaning as claimed in claim 1, wherein the step of removing the cleaning agent is accomplished by washing with water.

3. The method for cleaning as claimed in claim 1, wherein the step of removing the cleaning agent is accomplished by suctioning with a suction device.

4. The method for cleaning as claimed in claim 1, wherein said cleaning agent further includes a compound for controlling a pH value of the cleaning agent to enhance foaming.

5. The method for cleaning as claimed in claim 1, wherein said foam is formed by passing a gas under pressure through said cleaning agent.

6. A method for cleaning soil from a surface of an external wall of a building, comprising the steps of forming and maintaining a layer of a mousselike foam of a cleaning agent on the surface of the external wall of the building; and removing the cleaning agent foam and soil from the surface of the external wall of the building, wherein the cleaning agent is an aqueous solution which includes a surfactant selected from the group consisting of anionic, cationic and nonionic surfactants, and a compound for imparting foam stability to maintain the layer of foam on the wall surface to prevent scattering of the cleaning agent containing soil during removal and wherein said compound for imparting foam stability is selected from the group consisting of a water-soluble protein and a saponin.

7. A method for cleaning soil from a surface of an external wall of a building, comprising the steps of:

passing a gas under pressure through an aqueous cleaning agent to form a mousselike foam, said cleaning agent including a surfactant, a compound for controlling a pH value of said cleaning agent to enhance foaming, and a compound for imparting foam stability to maintain the layer of foam on the wall surface;

forming a layer of said foam of said cleaning agent on the external wall surface to prevent scattering of the cleaning agent containing soil during removal; and removing said foam layer from said external wall surface.

8. The method for cleaning as claimed in claim 7, wherein the step of removing said foam is accomplished by washing with water.

9. The method for cleaning as claimed in claim 7, wherein the step of removing said foam is accomplished by suctioning with a suction device.

10. The method for cleaning as claimed in claim 7, wherein said compound for imparting foam stability is a water-soluble protein.

11. The method for cleaning as claimed in claim 7, wherein said compound for imparting foam stability is a saporin.

12. A method for cleaning soil from a surface of an external wall of a building, comprising the steps of:

passing a gas under pressure through an aqueous cleaning agent to form a mousselike foam, said cleaning agent including a surfactant selected from the group consisting of anionic, cationic and nonionic surfactants, a compound for controlling a pH value of said cleaning agent to enhance foaming selected from the group consisting of an acid and an alkali, and a compound for imparting foam stability to maintain the layer of foam on the wall surface selected from the group consisting of a water-soluble protein and a saponin;

forming a layer of said foam of said cleaning agent on the external wall surface to prevent scattering of the cleaning agent containing soil during removal; and removing said foam layer from said external wall surface.

* * * * *

UNITED STATES PATENT AND TRADEMARK OFFICE

CERTIFICATE OF CORRECTION

PATENT NO. : 5,651,830

DATED : July 29, 1997

INVENTOR(S) : Kyouichi Yamaguchi

It is certified that error appears in the above-indentified patent and that said Letters Patent is hereby corrected as shown below:

Column 3 Line 28 "mousse-like" should read --mousselike--.

Claim 11 Column 6 Line 14 "saporin" should read --saponin--.

Signed and Sealed this

Sixteenth Day of December, 1997

*Attest:*

*Attesting Officer*

BRUCE LEHMAN

*Commissioner of Patents and Trademarks*